US006192996B1

(12) United States Patent
Sakaguchi et al.

(10) Patent No.: US 6,192,996 B1
(45) Date of Patent: Feb. 27, 2001

(54) MODE CHANGING MECHANISM FOR USE IN A HAMMER DRILL

(75) Inventors: Takahiro Sakaguchi; Yasutoshi Shimma, both of Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/648,504

(22) Filed: Aug. 25, 2000

(30) Foreign Application Priority Data

Aug. 26, 1999 (JP) ..... 11-240114

(51) Int. Cl.[7] ..... B25D 11/00
(52) U.S. Cl. ..... 173/48; 173/109; 173/201
(58) Field of Search ..... 173/48, 109, 114, 173/201, 200, 104

(56) References Cited

U.S. PATENT DOCUMENTS

| | | | | |
|---|---|---|---|---|
| 3,834,468 | * | 9/1974 | Hettich et al. | 173/48 |
| 4,349,074 | * | 9/1982 | Ince | 173/48 |
| 5,320,177 | | 6/1994 | Shibata et al. | 173/48 |
| 5,456,324 | * | 10/1995 | Takagi et al. | 173/109 |
| 5,842,527 | * | 12/1998 | Arakawa et al. | 173/104 |
| 6,035,945 | * | 3/2000 | Ichijyou et al. | 173/201 |
| 6,109,364 | * | 8/2000 | Demuth et al. | 173/48 |

FOREIGN PATENT DOCUMENTS 6-262413 9/1994 (JP) .

* cited by examiner

*Primary Examiner*—Scott A. Smith
(74) *Attorney, Agent, or Firm*—Lahive & Cockfield, LLP

(57) ABSTRACT

A hammer drill (1) includes an intermediate shaft (13), a clutch ring (25), a second gear (20), and a boss (15) all mounted on the intermediate shaft (13). Also included are a rotatable change lever (40) and a clutch plate (31) which has lock claws (36). When the change lever (40) is fully rotated in the clockwise direction, the hammer drill (1) is placed in a drill-only mode where the clutch ring (25) meshes only with the second gear (20). When the change lever (40) is rotated approximately 45 degrees counterclockwise from the foregoing position, the hammer drill (1) is placed in a hammer drill mode, where the clutch ring (25) meshes with the second gear (20) and the boss (15). When the change lever (40) is rotated approximately another 45 degrees counterclockwise, the hammer drill (1) is placed in a neutral position where tile second gear (20) is disengaged from the clutch ring (25), with the clutch ring (25) remaining in mesh with the boss (15). When the change lever (40) is rotated another 45 degrees counterclockwise, the hammer drill (1) enters into a hammer-only mode where the second gear (20) meshes with, and is prevented from rotation by, the lock claws (36) of the clutch plate (31).

7 Claims, 6 Drawing Sheets

MODE CHANGING MECHANISM FOR USE IN A HAMMER DRILL

This application claims priority on Japanese Patent Application No. 11-240114 filed on Aug. 26, 1999, the contents of which are incorporated herein by reference.

BACKGROUND OF THE INVENTION

1. Field of the Invention

The present invention relates to hammer drills. More particularly, the present invention relates to a type of hammer drill with selectable hammer and rotary operation modes.

2. Description of the Related Art

A certain type of hammer drill includes a clutch mechanism provided on an intermediate shaft which is disposed between the output shaft of the motor and the tool holder of a hammer drill. The clutch mechanism is capable of placing the hammer drill in different operating modes. Japan Published Unexamined Patent Application No. 6-262413 discloses one such clutch mechanism which includes a rotation transmitting member, Such as a gear, mounted on an intermediate shaft for transmitting rotation of a motor to a tool holder, and a strike transmitting member, such as a boss, also freely rotatably mounted on the intermediate shaft and having a piston arm for transmitting hammer blows to a bit held in the tool holder. The clutch mechanism further includes a clutch member which has clutch claws on both axial ends thereof and is disposed between the rotation transmitting member and the strike transmitting member. Additionally the clutch member is slidably disposed on the intermediate shaft so as also to be integrally rotatable with this shaft. By operating an external switch lever to change the axial position of the clutch member, an operator of this tool can place the tool into one of three operating modes: a rotation-only mode in which the clutch member engages the rotation transmitting member only; a rotation-plus-hammer mode in which the clutch member engages both the rotation transmitting member and the strike transmitting member; and a hammer-only mode in which the clutch member engages the strike transmitting member only.

While the foregoing switch mechanism achieves its intended objective, it is not free from certain problems and inconveniences. Generally, when a chisel, which is often used at a desired rotational angle, is attached to a hammer drill, it would be preferable if the drill were to permit adjustment of the rotational angle of the attached chisel or similar tool bit. In the foregoing hammer drill, however, when the tool is in the hammer-only mode, in which the clutch member engages the strike transmitting member only, the rotation transmitting member is disengaged from the clutch member so as to be freely rotatable. As the tool holder is in permanent engagement with the rotation transmitting member, the tool holder, and thus the attached bit, cannot be rotated to and secured at a new rotational angle. It is possible to provide the hammer drill with a function to fix the rotational angle of the bit by adding a separate mechanism which may include a locking device for preventing the rotation of the tool holder and the rotation transmitting member in the hammer-only mode. This not only contributes to increased cost of the tool, but it also reduces the overall operability of the tool, as such additional mechanism makes the operation of the tool all the more complicated.

SUMMARY OF THE INVENTION

In view of the above-identified problems, an important object of the present invention is to provide a hammer drill with a simple structure that permits mode selection from the aforementioned three operating modes and adjustment of the rotational angle of the tool bit.

Another object of the present invention is to provide a hammer drill that realizes higher ease of operation at a low cost.

The above objects and other related objects are realized by the invention, which provides a hammer drill having a plurality of selectable operating modes. The hammer drill includes: a motor; a housing; an intermediate shaft having a longitudinal axis and supported within the housing for being rotated upon activation of the motor; and a rotation transmitting member freely rotatably provided on the intermediate shaft and slidable along the longitudinal axis of the intermediate shaft. The rotation transmitting member, when rotated, transmits rotation of the motor to a tool bit attached to the hammer drill. The hammer drill further includes a strike transmitting member freely rotatably provided on the intermediate shaft, and a clutch member integrally rotatable with the intermediate shaft and slidable along the longitudinal axis of the intermediate shaft between the rotation transmitting member and the strike transmitting member. The strike transmitting member, when rotated, converts the rotation of the motor into hammer blows and transmitting the hammer blows to the tool bit, whereas the clutch member, when sliding, are capable of engaging, and integrally rotating with, at least one of the rotation transmitting member and the strike transmitting member. The hammer drill additionally includes a first switchover device for being externally operable to slide at least one of the clutch member and the rotation transmitting member, and a second switchover device interlocked with the first switchover device to slide whichever is not slid by the first switchover device of the clutch member and the rotation transmitting member. According to this hammer drill, the engagement status of the clutch member with the rotation transmitting member and with the strike transmitting member is changeable by operation of the first switchover device so as to select the operation mode of the hammer drill from a rotation-only mode, a rotation-plus-hammer mode, and a hammer-only mode. Particularly, in the hammer-only mode, the rotation transmitting member is movable between a free-rotation position in which the rotation transmitting member is permitted to rotate and a lockup position in which the rotation transmitting member is prevented from rotation by one of the first and second switchover devices.

The rotation transmitting member is adapted to be slidable in the axial direction, whereas the first switchover device allows selection of the three operating modes of the drill while providing, in the hammer-only mode, both a lockup position, in which the rotation transmitting member is prevented from rotation and a free-rotation or neutral position, in which the rotation transmitting member is not locked up, but is freely rotatable to allow the tool bit to be rotated to desired angles. This bit angle adjusting mechanism is realized merely by the addition of the second switchover device and the slide of the rotation transmitting member, thereby contributing to simplification of the overall structure and to cost reduction. The selectability of all three operating modes and the neutral position merely by means of the first switchover device ensures high operability of the hammer drill.

According to one aspect of the present invention, the first switchover device is a rotary lever that permits manual operation to selectively place the hammer drill in the three modes. Moreover, when the hammer drill is in the hammer-only mode, the first switchover device can be operated to slide the rotation transmitting member along the longitudinal axis between the lockup position, in which a first stopper provided in the rotation transmitting member engages the second switchover device so as to prevent rotation of the rotation transmitting member, and the free-rotation position.

According to another aspect of the present invention, the second switchover device is a clutch plate having a second stopper that engages the first stopper of the rotation transmitting member when the rotation transmitting member is in the lockup position and disengages from the first stopper of the rotation transmitting member when the rotation transmitting member is in the free-rotation position.

According to still another aspect of the present invention, the first switchover device, when operated to place the hammer drill in the hammer-only mode from the rotation-plus-hammer mode, slides the rotation transmitting member to disengage this member from the clutch member without disengaging the clutch member from the strike transmitting member.

According to yet another aspect of the present invention, the drill hammer further includes a spring that biases the second switchover device along the longitudinal axis in a direction in which the second stopper of this device engages the first stopper of the rotation transmitting member, and a tool holder to which the tool bit is attached and which is exposed for manual rotation so as to rotate the rotation transmitting device and thus the first stopper. According to this aspect, each of the first and second stoppers is a set of claws engageable with each other. In addition, when the first stopper claws fail to engage the second stopper claws, thus axially displacing the second switchover device from the lockup position, the first stopper claws can be manually rotated via the tool holder until the biasing force of the spring brings the second stopper claws into engagement with the first stopper claws in the lockup position.

According to one feature of the present invention, if the two sets of claws fail to establish engagement with each other, thus axially displacing the second switchover device from the lockup position in the hammer-only mode, the second switchover device has axial play in which to slide without disengaging the clutch member from the strike transmitting member.

According to another feature of the present invention, the clutch member has a substantially cylindrical shape having claws on two axial ends thereof for engaging the rotating transmitting member and the strike transmitting member.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

Figure 1:
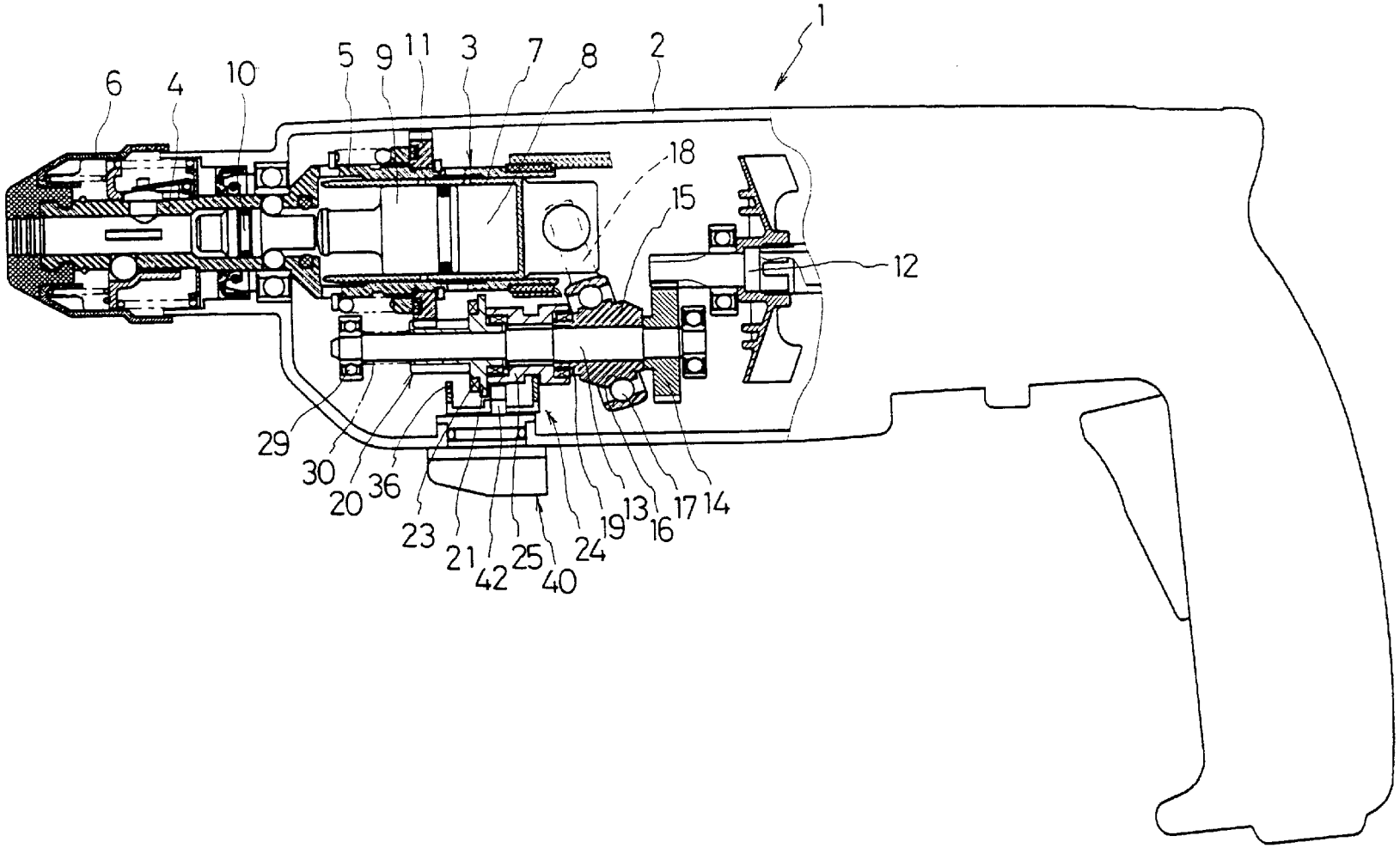
FIG. 1 is a partly sectional side view of a hammer drill 1 according to the present invention, shown with part of its housing 2 removed to expose its internal mechanisms.
Figure 5A:
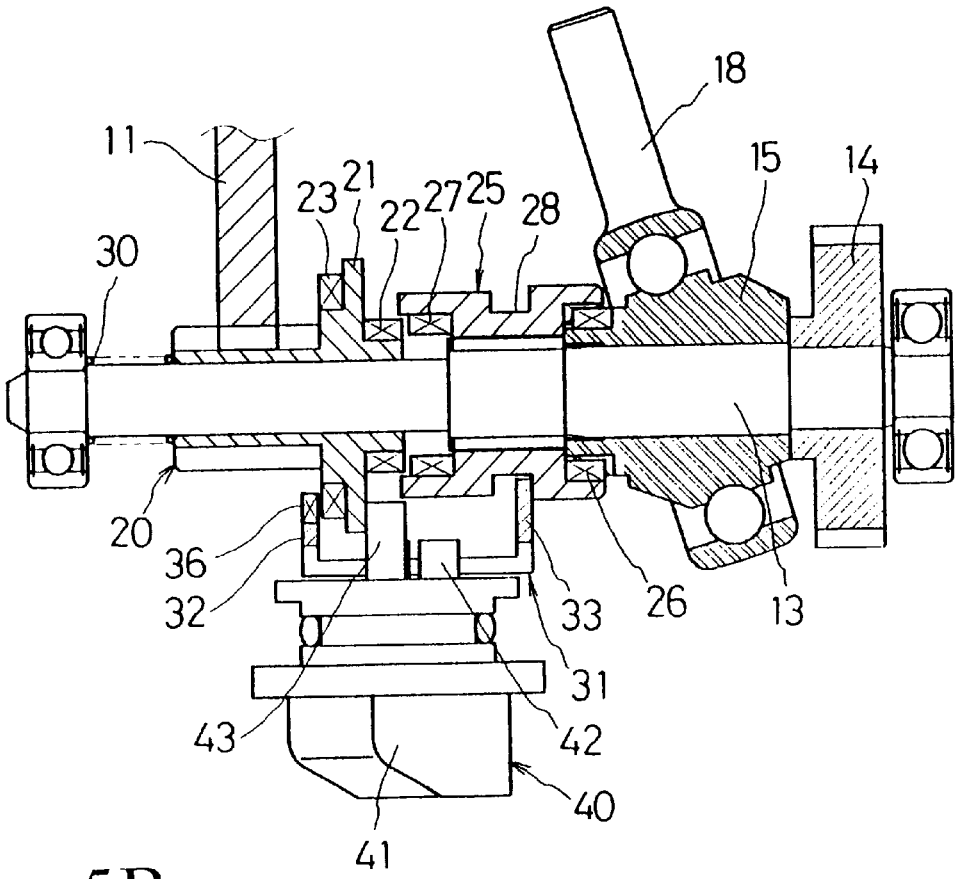
Figure 5B:
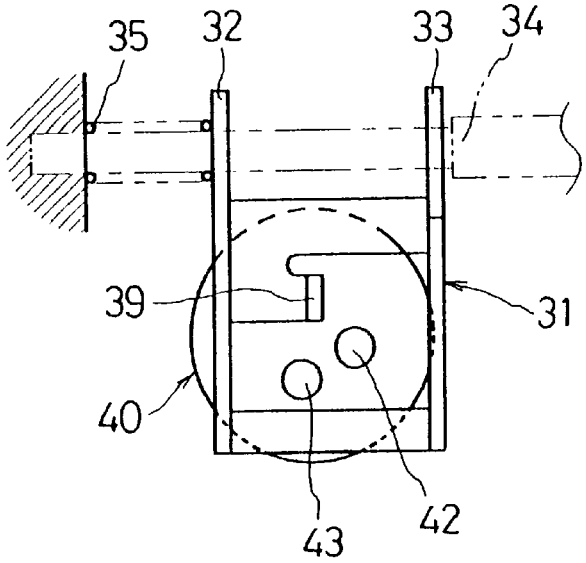
Figure 6A:
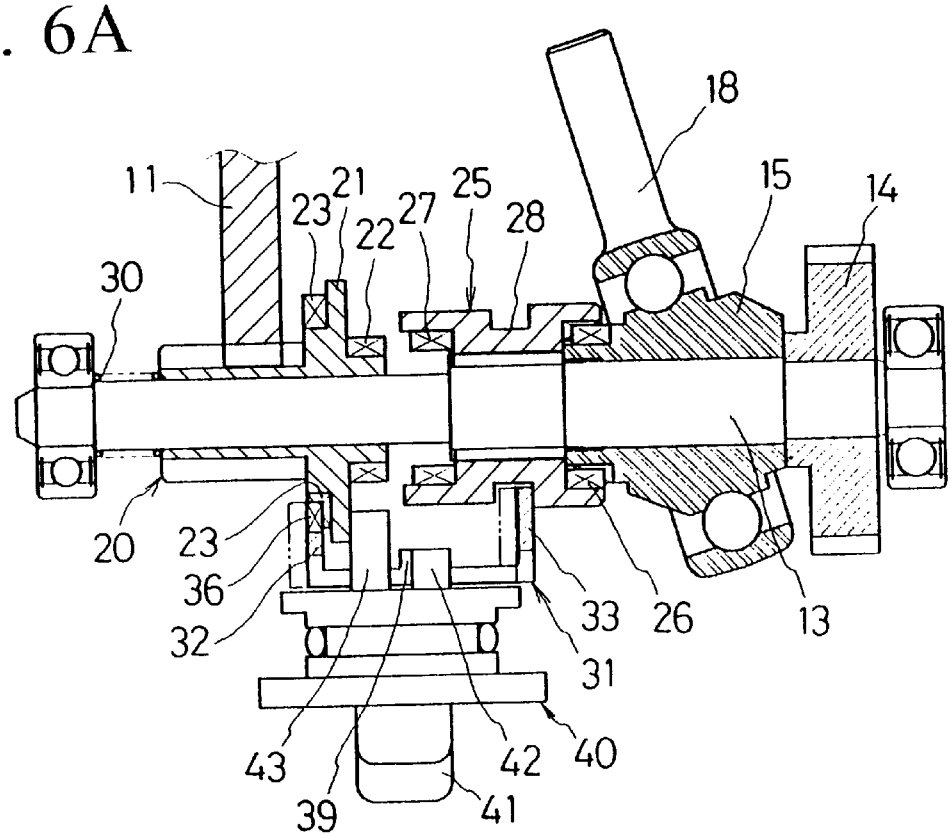
Figure 6B:
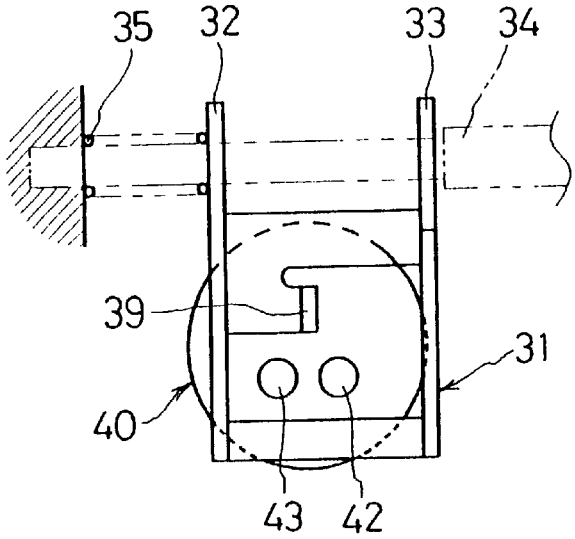

FIG. 5 shows the clutch mechanism 24 of the hammer drill 1 in FIG. 1 in a neutral position, with the top drawing being a side view of the mechanism and the bottom drawing being a plan view of the mechanisms; and FIG. 6 shows the clutch mechanism 24 of the hammer drill 1 in FIG. 1 in a hammer-only mode, with the top drawing being a side view of the mechanism and the bottom drawing being a plan view of the mechanism.

DETAILED DESCRIPTION OF THE PREFERRED EMBODIMENT

A preferred embodiment according to the present invention will be described hereinafter with reference to the attached drawings.

FIG. 1 is a partly sectional side view of a hammer drill 1 according to the present invention, shown with part of its housing 2 removed to expose its internal mechanisms. The hammer drill 1 includes a housing 2 in which a tool holder 3 is freely rotatably supported. The tool holder 3 in turn includes a small-diameter section 4 for securing a tool bit (not shown) therein by sliding of a top sleeve 6. The tool holder 3 additionally includes a large-diameter section 5 in which a piston cylinder 7 is slidably inserted from the rear (to the right of the drawing) thereof. The piston cylinder 7 slidably accommodates a striking member 9, whereas the small-diameter section 4 accommodates an intermediate member 10, the front end of which comes into abutment with the rear end of the tool bit attached to the drill 1. Reference numeral 8 denotes an air chamber formed adjacent to the striking member 9 in the large-diameter section 5 of the tool holder 3. Reference numeral 11 denotes a spur gear integrally provided on the outer surface of the large-diameter section 5.

The housing 2 further accommodates a motor (not shown) whose output shaft 12 meshes with a first gear 14 integrally formed with an intermediate shaft 13, thereby rotating the intermediate shaft 13 when the motor is activated. The intermediate shaft 13 is supported within the housing 2 in parallel with the longitudinal axis of the tool holder 3. A boss 15 is freely rotatably provided on the intermediate shaft 13 close to the rear end of the shaft 13 adjacent to the first gear 14 in order to generate hammer blows to be transmitted to the tool bit. Moreover, the boss 15 includes a circular groove 16 formed around the outer surface thereof at an angle to the longitudinal axis of the tool holder 3. A tilt arm 18 is connected to the circular groove 16 via a ball bearing 17, with an upper end of the arm 18 attached to the rear end of the piston cylinder 7. Furthermore, a second gear 20 is freely rotatably and slidably disposed on the front portion of the intermediate shaft 13 so as to mesh with the spur gear 11.

A clutch mechanism 24 is provided between the boss 15 and the second gear 20. As can be seen in further detail in FIG. 3, the clutch mechanism 24 includes a clutch ring 25 which is spline-connected to the intermediate shaft 13 so as to be integrally rotatable with the shaft 13 and slidable relative to the shaft 13 in the axial directions. The clutch mechanism 24 additionally includes a first switchover member or a change lever 40 for regulating the positions of the clutch ring 25 relative to that of the second gear 20. Further included in the clutch mechanism 24 is a second switchover member or a clutch plate 31. Provided on the rear surface of the clutch ring 25 are first clutch claws 26 that can engage stopper claws 19 provided on the front surface of the boss 15, whereas second clutch claws 27 are provided on the front surface of the clutch ring 25 so as to engage first mesh claws 22 provided on the rear surface of a flange 21 of the second gear 20. In addition, a coil spring is disposed between a ball bearing 29 at the front end of the intermediate shaft 13 and the second gear 20, thus biasing the second gear 20 in the rear direction.

Figure 2:
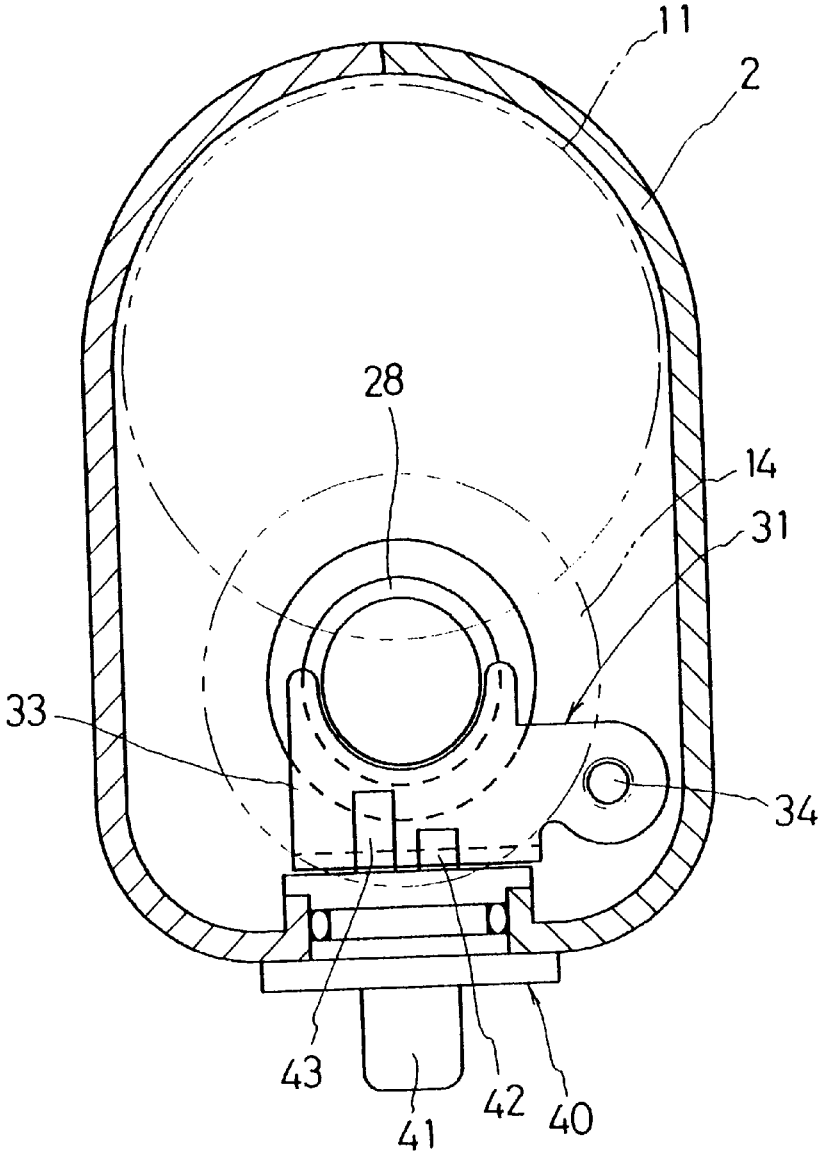
FIG. 2 is a cross section of the hammer drill of FIG. 1, showing a clutch plate 31 and a change lever 40, with elements omitted for clarity.
Figure 3A:
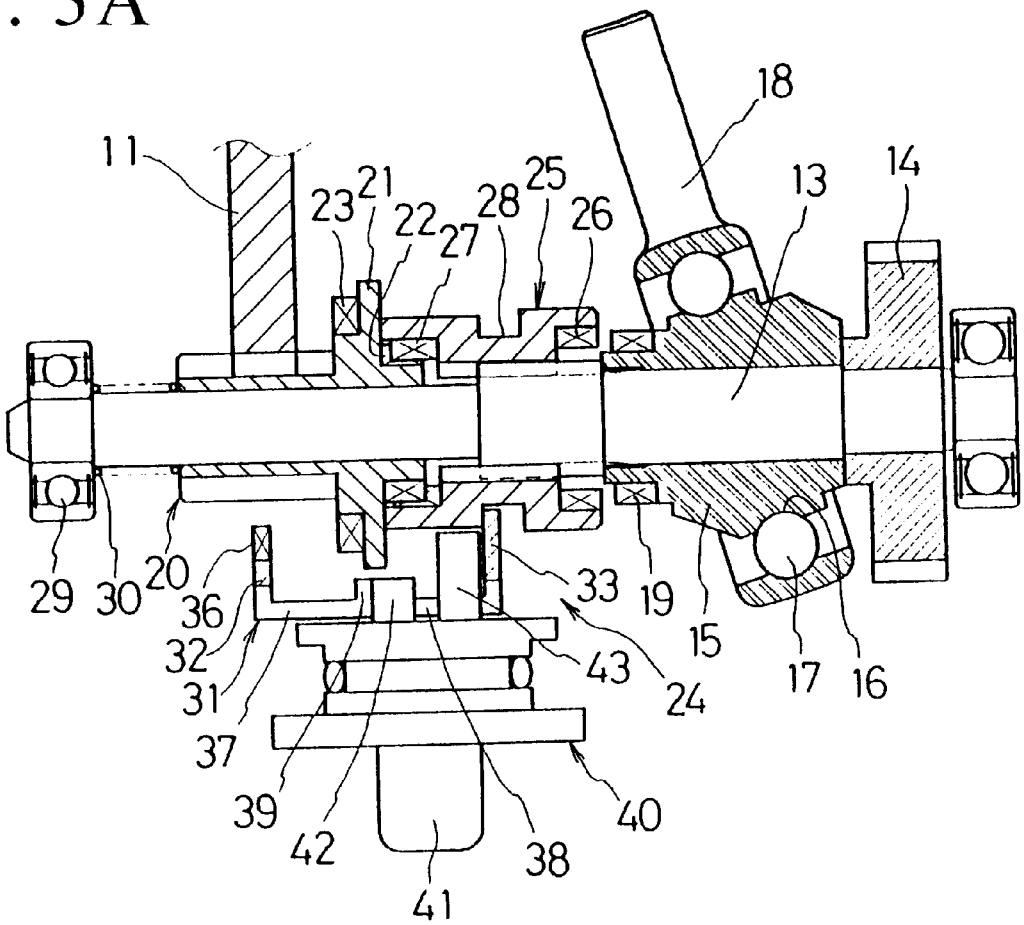
FIG. 3 shows the clutch mechanism 24 of the hammer drill 1 in FIG. 1 in a drill-only mode, with the top drawing being a side view of the mechanism and the bottom drawing being a plan view of the mechanism.
Figure 3B:
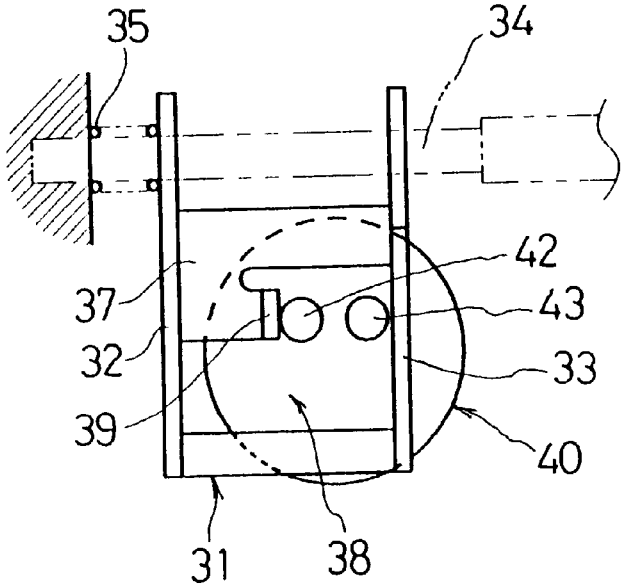

Still referring to FIG. 3, the clutch plate 31 includes a front plate 32 and a rear plate 33 which are parallel to each other but orthogonal to the longitudinal axis of the intermediate shaft 13. The front and rear plates 32 and 33 are penetrated by a guide bar 34 disposed parallel to the intermediate shaft 13 within the housing 2. A coil spring 35 is fitted around the guide bar 34 between the housing 2 and the front plate 32, thus biasing the clutch plate 31 in the rear direction. Additionally, lock claws 36 are provided on the front plate 32 for engaging second mesh claws 23 provided on the front surface of the flange 21 of the second gear 20. As also shown in FIG. 2, the top end of the rear plate 33 is inserted in a groove 28 formed around the center of the peripheral surface of the clutch ring 25. Reference numeral 38 designates a window provided in a coupling plate 37 for connecting the front plate 32 and the rear plate 33.

As shown in FIGS. 2 and 3 to 6, the change lever 40 has a circular shape supported on the lower surface of the housing 2 such that its axis is oriented orthogonally to the longitudinal axis of the intermediate shaft 13. An operating knob 41 projects outward from the undersurface of the change lever 40, whereas a long and a short eccentric pin 42 and 43 project inward from the inner surface of the change lever 40, penetrating the window 38 of the clutch plate 31. As the change lever 40 is manually rotated, the short eccentric pin 42 comes into detachable contact with a contact projection 39 of the coupling plate 37 of the clutch plate 31 while the long eccentric pin 43 comes into detachable contact with the flange 21 of the second gear 20. According to the clutch mechanism 24, therefore, as the change lever 40 is rotated, the short eccentric pin 42 is moved along the front-rear direction by an amount corresponding to the amount of rotation of the pin 42. Therefore, the slide position of the clutch plate 31 and the clutch ring 25, which are both biased rearward, thus can be controlled by the rotation of the lever 40 and thus the amount of front-rear movement (or the amount of movement along the guide bar 34) of the eccentric pin 42. Similarly, as the change lever 40 is rotated, the long eccentric pin 43 is moved along the front-rear direction by the amount that corresponds to the amount of rotation of the pin 43. Therefore, the slide position of the rearward-biased second gear 20 can be controlled by the rotation of the lever 40 and thus the amount of front-rear movement (or the amount of movement along the guide bar 34) of the eccentric pin 43.

Three operating modes are available for the hammer drill 11 by rotation of the change lever 40. When the change lever 40 is rotated to the position shown in FIG. 3, the hammer drill 1 enters into a drill mode (rotation-only mode). In this mode or position, the short eccentric pin 42 is located in front of the long eccentric pin 43, with the pin 42 abutting the contact projection 39 of the clutch plate 31 so as to slide the plate 31 to its forwardmost position against the biasing force of the coil spring 35. Simultaneously, the rear plate 33 in the groove 28 moves the clutch ring 25 forward. In this position, therefore, the second clutch claws 27 on the front of the clutch ring 25 engage the second mesh claws 22 on the rearward biased second gear 20, whereas the first clutch claws 26 are disengaged from the stopper claws 19 of the boss 15. When the motor is activated, the intermediate shaft 13 and the clutch ring 25, which is connected to the shaft 13, rotate integrally, thus causing rotation of the second gear 20 only. This in turn causes rotation of the tool holder 3 and thus the tool bit via the spur gear 11

Figure 4A:
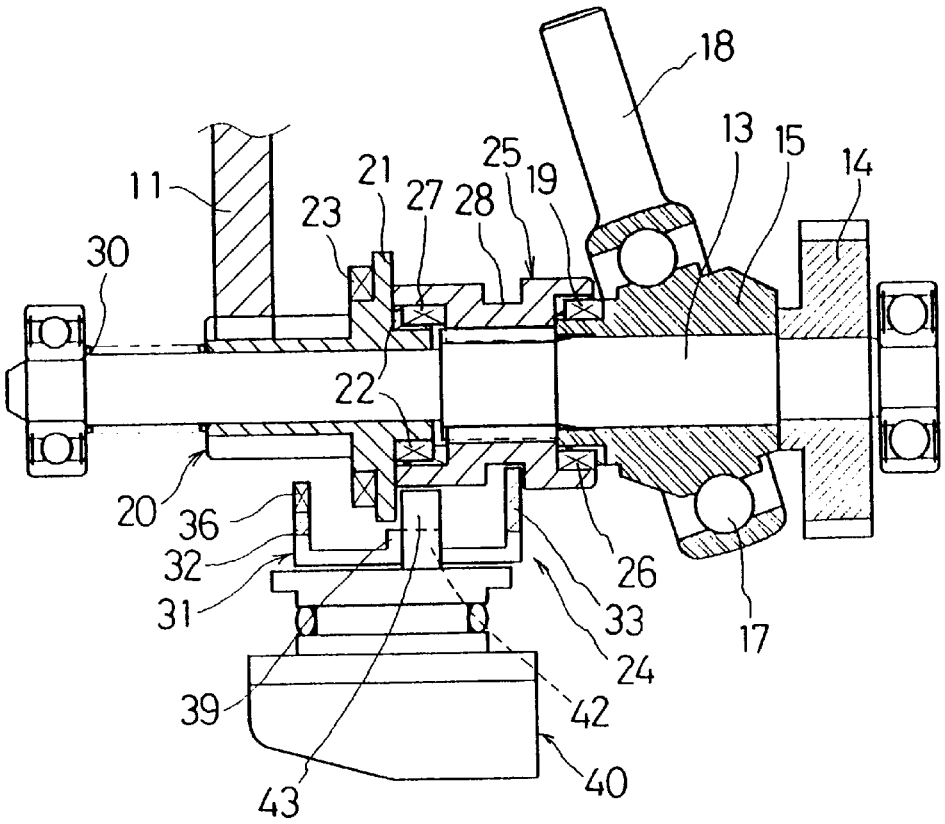
FIG. 4 shows the clutch mechanism 24 of the hammer drill 1 in FIG. 1 in a hammer drill mode, with the top drawing being a side view of the mechanism and the bottom drawing being a plan view of the mechanism.
Figure 4B:
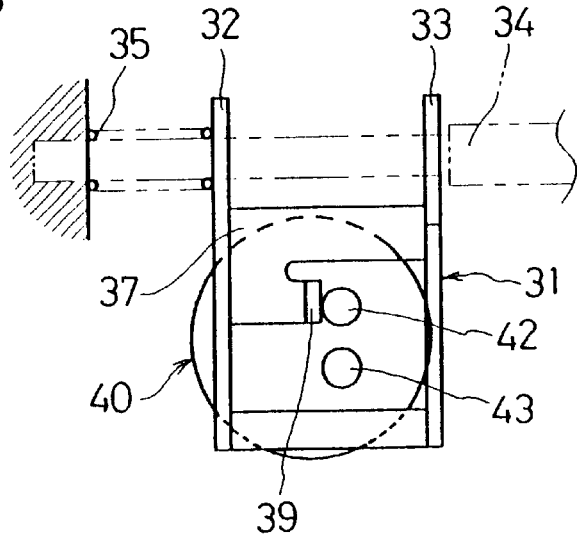

When the change lever 40 is rotated 90 degrees counterclockwise from the position shown in FIG. 3 to the position in FIG. 4, the hammer drill 1 is placed in a hammer drill mode (rotation-plus-hammer mode). As shown in FIG. 4, the eccentric pins 42 and 43 are aligned orthogonal to the longitudinal axis of the intermediate axis 13. Simultaneously, the clutch plate 31, as its contact projection 39 is maintained in abutment with the short eccentric pin 42 by the biasing force of the coil spring 35, is moved rearward together with the pin 42 by the same biasing force. As the clutch plate 31 is moved rearward, the clutch ring 25 and the second gear 20 are also moved rearward by the biasing force of the coil spring 30. This engages the first clutch claws 26 on the rear surface of the clutch ring 25 with the stopper claws 19 of the boss 15. Concomitantly, the second clutch claws 27 on the front surface of the clutch ring 25 engage the first mesh claws 22 of the second gear 20. When the motor is activated in this hammer drill mode, the intermediate shaft 13 and the clutch ring 25 rotate, thus causing rotation of the second gear 20 and the boss 15. The rotation of the gear 20 causes rotation of the spur gear 11 and thus the tool holder 3, whereas the rotation of the boss 14 causes reciprocating motion of the tilt arm 18 and thus the piston cylinder 7. This creates an air spring in the air chamber 8, which causes the striking member 9 to repeatedly strike the intermediate member 10, thus transmitting hammer blows to the tool bit.

When the change lever 40 is rotated a further 45 degrees counterclockwise from the position shown in FIG. 4 (the rotation-plus-hammer mode) to the position shown in FIG. 5, the hammer drill 1 is placed in a neutral position. As shown in FIG. 5, the eccentric pin 42 is detached from the contact projection 39 of the clutch plate 31. Concomitantly, the eccentric pin 43 is moved forward into abutment with the flange 21 of the second gear 20 and pushes the gear 20 forward against the biasing force of the coil spring 30. In this position (the neutral position), the clutch ring 25 remains engaged with the boss 14, whereas the second clutch claws 27 on the front of the clutch ring 25 are disengaged from the second mesh claws 22 of the second gear 20. Additionally, the clutch plate 31 is urged rearward by the coil spring 35 with the rear plate 33 abutting the rear side surface of the groove 28, whereas the lock claws 36 of the front plate 32 do not engage the second mesh claws 23 of the flange 21 of the second gear 20.

In the neutral position, only the rotation of the boss 15 can be transmitted, with the second gear 20 being unable to transmit the rotation of the motor and rendered freely rotatable. Therefore, the tool bit, such as a chisel or drill steel, can be manually rotated to a desired angle.

When the change lever 40 is rotated a further 45 degrees counterclockwise from the position shown in FIG. 5 (the neutral position) to the position in FIG. 6, the hammer drill 1 is placed in a hammer-only mode. As shown in FIG. 6, in this position, the eccentric pin 43, and thus the second gear 20, have been moved slightly forward. Accordingly, the second mesh claws 23 of the flange 21 of the second gear 20 engage the lock claws 36 of the front plate 32, where only hammer blows can be transmitted to workpieces via the tool bit. When the change lever 40 is rotated to this position from the previous position, the second mesh claws 23 may not properly mesh with the lock claws 36. If this occurs, the claws 23 may clash with the claws 36 and push the clutch plate 31 forward as indicated in alternate long and two short dashed lines. It should be noted, however, that due to the front-rear clearance in the groove 28 for the rear plate 33 of the clutch plate 31, an operator can manually rotate the tool holder 3, and thus the second gear 20, until the lock claws 36 of the clutch plate 31 properly engage the second mesh claws 23 of the gear 20 as the clutch plate 31 is moved rearward. In this way, the second gear 20 is locked up and prevented from rotation.

In the hammer-only mode, therefore, when the motor is activated, the intermediate shaft 13 and the clutch ring 25, but not the second gear 20, are rotated to transmit hammer blows to workpieces via the tool bit. As the second gear 20 is prevented from rotation by the clutch plate 31, the rotational angle of the tool bit selected in the neutral position is maintained during the operation of the hammer drill 1.

As described above, according to the hammer drill 1 of the foregoing embodiment, three modes of operation (the drill-only mode, the hammer drill mode, and the hammer-only mode) are available by operating the change lever 40 and indirectly the clutch plate 31. In addition, in the hammer mode, the slide position of the axially movable second gear 20 is changeable along the intermediate shaft 13 to a neutral position, where the rotational angle of the tool bit can be manually adjusted. This bit angle adjusting mechanism is realized merely by the addition of the clutch plate 31 and slide movement of the second gear 20, thereby contributing to simplification of the overall structure and to cost reduction. The selectability of all three operating modes and the neutral position merely by means of the change lever 40 ensures high operability of the tool 1.

In the foregoing embodiment, the rotatably operable change lever 40 is used as the first switchover device and the axially slidable clutch plate 31 is used as the second switchover device. Other types of mechanisms may replace these devices, without departing from the spirit of the invention, to achieve the same functions, i.e., selection of the three mode plus the neutral position by sliding the rotation transmitting member, such as the second gear 20, through coordination of the two switchover devices. For example, the change lever 40 may be replaced with a slidable member have a tapering projection for sliding the clutch plate 31 and the second gear 20 as the member is slid orthogonally to the clutch plate.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. A hammer drill having a plurality of selectable operating modes, comprising:

a motor;

a housing;

an intermediate shaft having a longitudinal axis and supported within the housing for being rotated upon activation of the motor;

a rotation transmitting member freely rotatably provided on the intermediate shaft and slidable along the longitudinal axis of the intermediate shaft, the rotation transmitting member, when rotated, transmitting rotation of the motor to a tool bit attached to the hammer drill;

a strike transmitting member freely rotatably provided on the intermediate shaft, the strike transmitting member, when rotated, converting the rotation of the motor into hammer blows and transmitting the hammer blows to the tool bit;

a clutch member integrally rotatable with the intermediate shaft and slidable along the longitudinal axis of the intermediate shaft between the rotation transmitting member and the strike transmitting member;

a first switchover device for being externally operable to slide at least one of the clutch member and the rotation transmitting member; and a second switchover device interlocked with the first switchover device to slide the other one of the clutch member and the rotation transmitting member which is not slid by the first switchover device, wherein the engagement status of the clutch member with the rotation transmitting member and with the strike transmitting member is changeable by operation of the first switchover device so as to select the operation mode of the hammer drill from a rotation-only mode, a rotation-plus-hammer mode, and a hammer-only mode, and in the hammer-only mode, the rotation transmitting member is movable between a free-rotation position in which the rotation transmitting member is permitted to rotate and a lockup position in which the rotation transmitting member is prevented from rotation by one of the first and second switchover devices.

2. A drill hammer in accordance with claim 1, wherein the first switchover device is a rotary lever that permits manual operation to selectively place the hammer drill in the three modes and when the hammer drill is in the hammer-only mode, the first switchover device can be operated to slide the rotation transmitting member along the longitudinal axis between the lockup position, in which a first stopper provided in the rotation transmitting member engages the second switchover device so as to prevent rotation of the rotation transmitting member, and the free-rotation position.

3. A drill hammer in accordance with claim 2, wherein the second switchover device is a clutch plate having a second stopper that engages the first stopper of the rotation transmitting member when the rotation transmitting member is in the lockup position and disengages from the first stopper of the rotation transmitting member when the rotation transmitting member is in the free-rotation position.

4. A drill hammer in accordance with claim 3 further comprising:

a spring that biases the second switchover device along the longitudinal axis in a direction in which the second stopper of this device engages the first stopper of the rotation transmitting member, and a tool holder to which the tool bit is attached and which is exposed for manual rotation so as to rotate the rotation transmitting device and thus the first stopper, wherein each of the first and second stoppers is a set of claws engageable with each other, and further wherein, when the first stopper claws fail to engage the second stopper claws, thus axially displacing the second switchover device from the lockup position, the first stopper claws can be manually rotated via the tool holder until the biasing force of the spring brings the second stopper claws into engagement with the first stopper claws in the lockup position.

5. A drill hammer in accordance with claim 4, wherein if the two sets of claws fail to establish engagement with each other, thus axially displacing the second switchover device from the lockup position in the hammer-only mode, the second switchover device has axial play in which to slide without disengaging the clutch member from the strike transmitting member.

6. A drill hammer in accordance with claim 1, wherein the first switchover device, when operated to place the hammer drill in the hammer-only mode from the rotation-plus-hammer mode, slides the rotation transmitting member to disengage this member from the clutch member without disengaging the clutch member from the strike transmitting member.

7. A drill hammer in accordance with claim 1, wherein the clutch member has a substantially cylindrical shape having claws on two axial ends thereof for engaging the rotating transmitting member and the strike transmitting member.

* * * * *